US007077603B2

(12) United States Patent
Fontaine et al.

(10) Patent No.: US 7,077,603 B2
(45) Date of Patent: Jul. 18, 2006

(54) STRESS LIMITING DEVICE FOR OFFSHORE OIL RESERVOIR PRODUCTION PIPE

(75) Inventors: Emmanuel Fontaine, Chatillon (FR); Gilles Perrin, Versailles (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 11/008,244

(22) Filed: Dec. 10, 2004

(65) Prior Publication Data

US 2005/0175413 A1 Aug. 11, 2005

(30) Foreign Application Priority Data

Dec. 10, 2003 (FR) ..... 03 14548

(51) Int. Cl.
*F16L 1/14* (2006.01)

(52) U.S. Cl. ..... 405/168.1

(58) Field of Classification Search ..... 405/168.1, 405/171, 172

See application file for complete search history.

(56) References Cited

U.S. PATENT DOCUMENTS 4,332,509 A * 6/1982 Reynard et al. ..... 405/168.1
4,570,716 A 2/1986 Genini et al.
4,808,031 A * 2/1989 Baker ..... 405/168.1
4,909,669 A * 3/1990 Baker ..... 405/168.1
6,102,077 A * 8/2000 Legallais et al. ..... 138/115
6,146,052 A * 11/2000 Jacobsen et al. ..... 405/169
6,267,537 B1 * 7/2001 Breivik et al. ..... 405/171
6,276,456 B1 * 8/2001 Head ..... 405/168.1

FOREIGN PATENT DOCUMENTS

FR 2 840 350 5/2003
WO WO 99/66169 12/1999

OTHER PUBLICATIONS

French Preliminary Search Report for FR 0314548, Jul. 26, 2004.

* cited by examiner

*Primary Examiner*—Frederick L. Lagman
(74) *Attorney, Agent, or Firm*—Antonelli, Terry, Stout and Kraus, LLP.

(57) ABSTRACT

The present invention relates to a device for improving the fatigue strength of a metal pipe a portion of which lies on the sea bottom and one end of which is suspended from a floating support subjected to the dynamic motions of the sea which move the touchdown point (TDP) of the pipe. The device comprises stress limiting means comprising a material (13) inserted between the pipe and the ground, in the vicinity of the touchdown point, the system thus created having a lineic stiffness below 200 kN/m/m and a thickness determined in such a way that the static and cyclic deformations remain allowable.

14 Claims, 4 Drawing Sheets

FIG.3
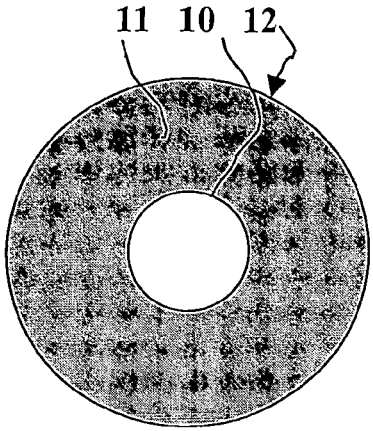
FIG.3A
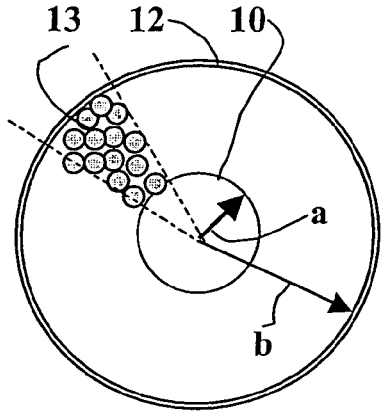
FIG.4
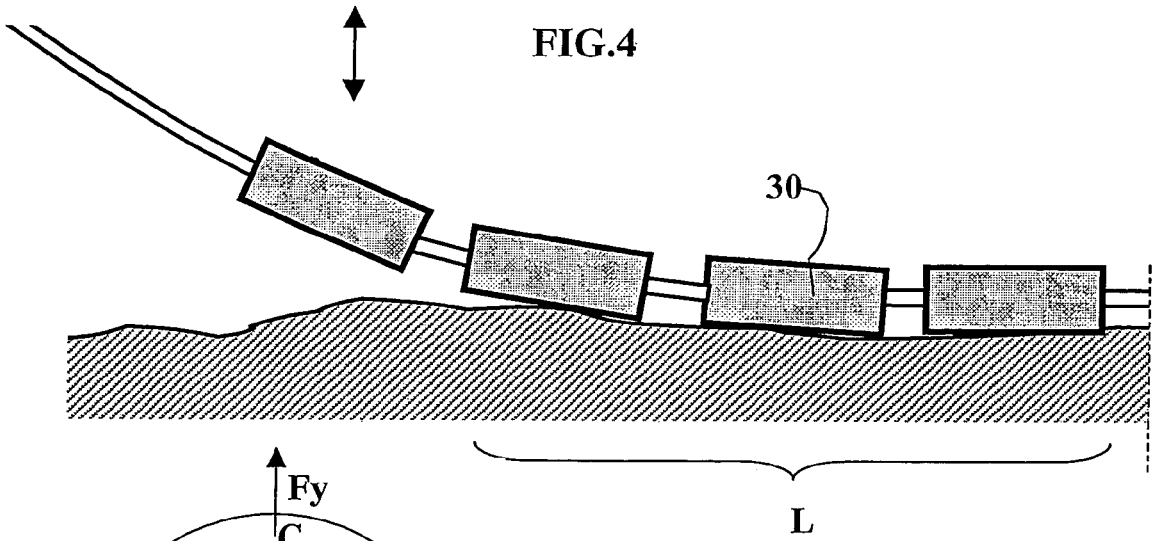
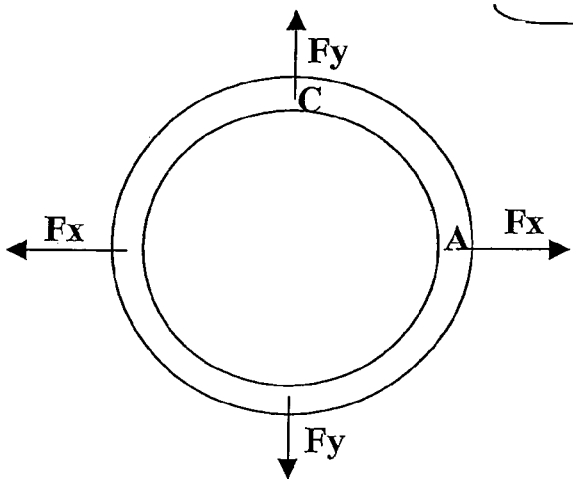
FIG.5

Figure 6
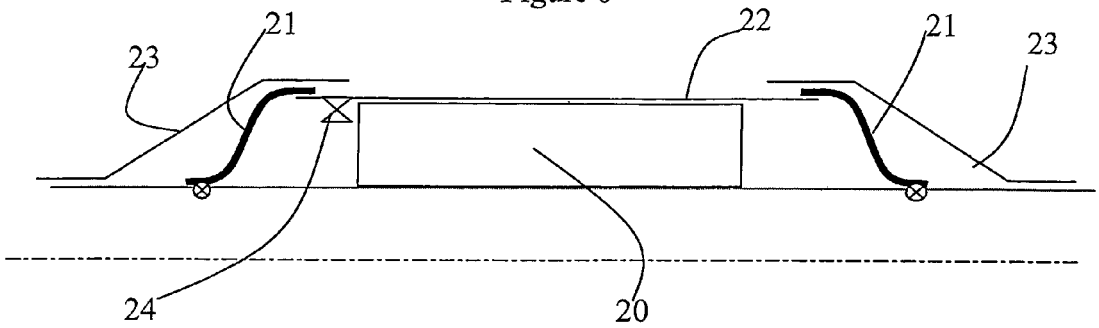
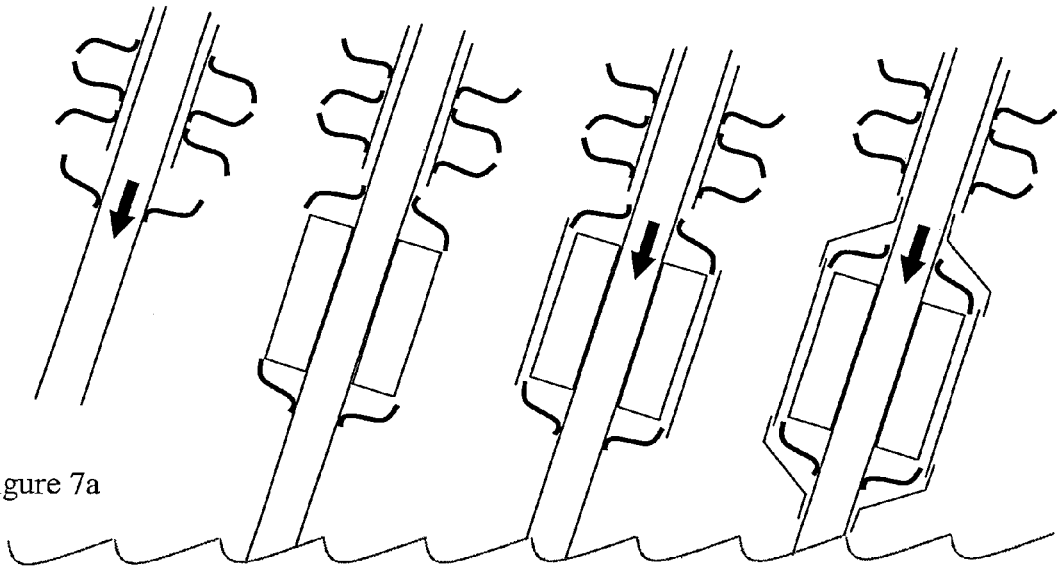
Figure 7a
Figure 7b
Figure 7c
Figure 7d

STRESS LIMITING DEVICE FOR OFFSHORE OIL RESERVOIR PRODUCTION PIPE

FIELD OF THE INVENTION

The present invention relates to the sphere of offshore oil reservoir production, where transport pipes connecting subsea wellheads to surface installations, loading buoys, semi-submersibles, etc., are used.

BACKGROUND OF THE INVENTION

These transport pipes can be SCR type (Steel Catenary Riser) pipes, i.e. metal pipes assembled by welding and running through the water depth. FIG. 1 hereafter describes the architecture of this type of pipes. Reference number 1 refers to a floating support, a tanker for example, connected to the subsea wellheads (not shown) by a riser pipe 2 whose upper end is suspended from the ship and a portion 3 of which lies on the sea bottom 4. This type of J-shaped metal pipe has a critical point 5 in the touchdown point zone TDP.

As regards the structure, the weak point of a SCR type production pipe is located at the level of the parting zone close to the first touchdown point.

In the lower zone of the riser, near to the TDP, the curvature exhibits a maximum that is translated at the mechanical level into a bending stress peak. When the riser is subjected to a dynamic stress, as it is the case in the presence of wave motion, the greatest curvature variations (and therefore the stress variations) are observed in the TDP zone, locally inducing a significant fatigue increase.

The object of the present invention is to limit the stresses and therefore the fatigue in this critical zone.

SUMMARY OF THE INVENTION

The present invention thus relates to a device for improving the fatigue strength of a metal pipe one portion of which lies on the sea bottom and one end of which is suspended from a floating support subjected to the dynamic motions of the sea which move the touchdown point (TDP) of the pipe, said device comprising stress limiting means including a material inserted between said pipe and the ground, in the vicinity of said touchdown point, said material having a lineic stiffness below 200 kN/m/m, and physical and geometrical parameters determined in such a way that the deformations of the material do not exceed an allowable limit defined according to a determined life.

The means can be cylindrical and surround the pipe over a determined length.

The material can consist of an assembly of protective tubes open at the ends thereof.

The protective tubes can be made of soft polymer.

The protective tubes having a radius R, a wall thickness e, for a radius b of a cylinder arranged around a pipe of radius a, b/a can range between 1.73 and 9, and e/R can range between 0.079 and 0.126.

The stress limiting means can have a length ranging between 1 and 100 m, preferably between 2 and 10 m.

BRIEF DESCRIPTION OF THE FIGURES

Other features and advantages of the invention will be clear from reading the description hereafter of non limitative embodiment examples, with reference to the accompanying figures wherein:

FIG. 3 diagrammatically shows the device according to the invention,

FIG. 3A describes a variant according to the invention,

FIG. 4 describes an embodiment and an implementation of the present invention, FIG. 5 is a sectional view of an elementary protective tube, FIG. 6 shows the principle of an embodiment, FIGS. 7*a, b, c* and *d* show an installation example.

DETAILED DESCRIPTION

Figure 1:
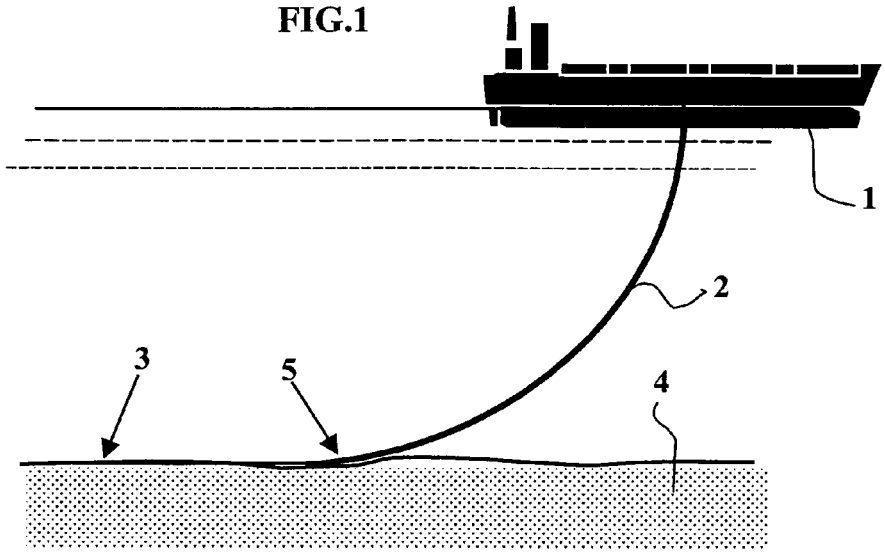
PRIOR ART FIG.1
FIG. 1 illustrates a SCR type pipe.

FIG. 1, already described above, illustrates a SCR type pipe, i.e. a metal pipe suspended from a floating support, J-shaped, a portion of the pipe lying on the sea bottom.

Figure 2:
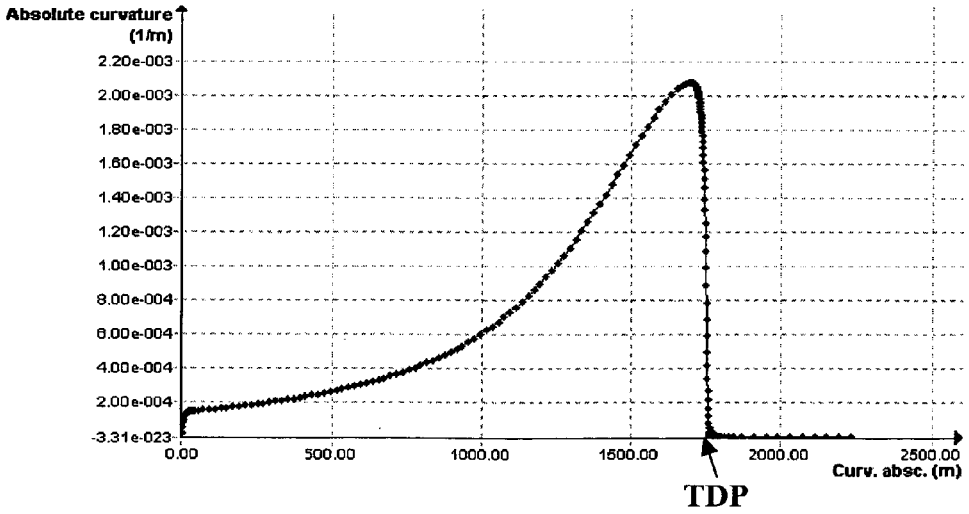
FIG. 2 shows the curvature variation in the metal SCR pipe.

FIG. 2 gives, on the ordinate, the value of curvature (C) of the pipe ($m^{-1}$), as a function of the curvilinear (m) abscissa (X) of the point considered from the pickup point. In the vicinity of the TDP, the curvature value is maximum, which induces a maximum stress in this zone.

An essential parameter for evaluation of the structural damage is the vertical stiffness used to account for the contact with the ground. This vertical stiffness allows the pipe/ground interaction to be modelled. Simulations show that the softer the ground, the more the temporal curvature variations are attenuated and the longer the life.

A study has been carried out to better apprehend the physics of the phenomenon. The life estimations using quasi-static or dynamic simulations are very different. When the dynamic effects are disregarded, the life is very long. This therefore suggests that the fatigue at the TDP is generated by the structural waves that are propagated along the riser, and partly reflected, absorbed or transmitted in the ground at the level of the TDP. The celerities estimated from calculations obtained from the DeepLines™ software (Institut Francais du Pétrole) are of the order of 40 m/s, and seem to show that these waves are equivalent, by nature, to taut wire waves. Locally, the interaction stiffness plays a part in the boundary condition encountered by the structure. It appears that the greater the pipe/ground interaction stiffness, the more the contrast between the aqueous environment (case of the out-of-contact zone) and the ground environment (case of the zone in contact) is marked, and the more the structural waves tend to be reflected. This has the consequence of causing, just upstream from the TDP, greater variations of the bending moment.

As for the pipe/ground interaction models, several approaches have been proposed in the literature. The value of the interaction stiffness depends, among other things, on the diameter of the pipe, on the cohesion of the ground, and on the type of stress applied (static, cyclic, . . . ). The detailed bibliographic analysis leads to the conclusion that the stiffness values predicted by the theoretical or analytical models are very scattered. Thus, they vary by a factor 100 depending on the models. On the other hand, experimental studies show that the effective stiffness varies significantly with each important cycle. Furthermore, between two cycles of different amplitude, the mean stiffness during the cycle can vary by a factor 100. In fact, although the averaged stiffness is generally low for significant displacements of the pipe in a soft ground, great stiffness values are however observed for low-amplitude cycles, or during unloading stages. The effective stiffness can then reach a hundred times the cohesion of the ground.

Besides, for clayey soils at great sea depths, measurements in the field show that the cohesion of the ground increases greatly when sinking into the superficial layer. If, at the surface, the cohesion is of the order of 1 kPa, values from 5 to 10 kPa can be reached from a depth of 1 meter. These high cohesion values are likely to be effectively encountered by the riser, in particular if it digs a trench in the ground as a result of the cyclic motions applied thereto by the floating support.

Thus, at the design stage, selection of a realistic ground cohesion value has direct consequences on the life of the riser. Too great a stiffness of the ground could turn out to be unacceptable for a field architecture concept involving a FPSO type floating support with SCR risers. Even when the concept is viable, the fatigue calculation reliability can be questioned considering the unknowns linked with the taking into account of the ground.

According to the prior art, the interaction stiffness between the pipe and the ground is determined by applying the DNV standard (Det Norske Veritas) "Free Spanning Pipelines"—Guidelines No.14. The stiffness depends on the lineic mass and on the diameter of the pipe, and on the ground parameters (cohesion, submerged specific gravity). Typically, stiffnesses from 20 to 400 kN/m/m are obtained in the case of catenary risers (SCR). This stiffness value is then used in a finite-element model (DeepLines™ for example) to determine the life of the installation.

Using the device according to the invention allows to be free from these standards relative to the stiffness, and to mechanically impose a suitable value, i.e. a value leading to an acceptable life for the installation. The objective of the device is in fact to impose an upper boundary on the stiffness of interaction with the ground.

The device according to the invention allows to limit the pipe/ground interaction stiffness and aims to limit the bending stress variations undergone by the pipe at the level of the TDP. It is therefore suggested to surround the pipe with an outer sheath in all the region of the TDP, or at least to insert it between the pipe and the ground. FIG. 3 diagrammatically shows the section of metal pipe 10 surrounded by a material 11 of determined stiffness and by an outer sheath 12. FIG. 3A is a sectional view of an embodiment of the stress limiting device consisting of the parallel assembly of protective tubes 13 whose outside diameter and inside diameter are determined according to the desired overall stiffness for the assembly surrounded by outer sheath 12. FIG. 4 shows an embodiment of the invention where the SCR pipe is surrounded, over a zone L corresponding to the displacement of the TDP depending on the motion of the floating support, by a series of stress limiting means 30.

The function of this limiting device is to provide the pipe with a "stiffness covering" whose lineic value is controlled, put up, of the order of 200 kN/m/m (less if possible). The presence of this device thus allows the life of the installation to be significantly increased.

Mechanically, the outer sheath considered generates no significant additional bending stiffness for the pipe section. To reduce this additional bending stiffness even further, the stress limiting sheath can be advantageously arranged in sections along the riser as shown in FIG. 4.

However, along the pipe, in the touchdown point zone, any stiffness discontinuity could be likely to cause local stress variations and therefore fatigue. The aforementioned use by sections therefore requires a beam type study according to the length of the sheath sections and to the free pipe distance between successive sections.

The float weight of the constituent material of the stress limiting device, which can be flooded, is selected of little weight so as not to significantly modify the initial mechanical characteristics of the pipe.

Besides, the outer surface of the sheath can be protected from abrasion on the ground by means of metal shells arranged on the outer surface. These shells can for example be made of stainless steel to prevent any corrosion problem. In addition to the material protection function, these shells also contribute to the good mechanical strength of the assembly.

Such a device allows to control the stiffness encountered by the SCR in the TDP zone. The value of the interaction stiffness has to be as low as possible. This value is however determined by the mechanical properties of the material used for the sheath.

The sheath thickness is calculated by taking into account the stress allowable by the material: considering the large number of cycles (of the order of 10 millions for an acceptable life), the deformations undergone have to remain within an allowable range for this number of cycles in relation to the fatigue criterion of the constituent material, to preserve the integrity of the device in the course of time.

As for the interaction between the device and the ground, the contact surface to be taken into account is that of the protective device. Considering the diameters ratio, this surface is of the order of 2 to 10 times as large as the surface of the device directly in contact with the ground. The vertical reaction (generated by the apparent weight of the pipe, of the sheath and by the bending stress) is thus distributed over a larger floor surface. The stress is locally lower, as well as the vertical displacements of the assembly. On the other hand, the displacements of the central pipe can be greater, of the order of some centimeters, as desired, since it is the constituent material of the device that deforms.

The method of determining the material of the stress limiting means takes account of the following criteria:

1. The pipe has an outside diameter ranging between 0.25 and 0.61 m (between 10" and 24"), but generally close to 0.508 m (20"), 2. The protective material is preferably cylindrical with a radius b, 3. This sheath must, on the one hand, if it is stationary, hold the inner pipe (initially centered) in radial translation with a small "stiffness" (lineic force per displacement increment), in any case below 200 kN/m/m; for example, for the calculations below, we take 100 kN/m/m, 4. The displacement of the pipe in relation to the center of the sheath is of the order of 1.5 to 3 times its float lineic weight divided by the stiffness, i.e. 3. (1000 N/m)/($10^5$ N/m/m)=$3.10^{-2}$ m;

5. This sheath must also withstand the contact/friction on the ground,

6. The system must work at a hydrostatic external pressure ranging between 10 and 30 MPa, 7. The thermal balance has to be checked (the solution by sections can create alternately hot and cold metal pipe zones, hence thermal deformations), 8. The float lineic weight should not be increased too much, or should even be decreased, 9. The stiffness of the pipe should not be increased too much, 10. The added mass for the dynamic calculations should not be increased too much.

EXAMPLE

Polymer-based Stress Limiting Material

Polymers in the rubbery state have a modulus of the order of 1 megapascal. By making them porous (90%), the modulus of the polymer/cavities composite is decreased to 100 kPa, which is liable to meet criterion 3.

Selection of a soft polymer allows a cyclic displacement that does not exceed 30 mm over a distance (radius b) below 1 meter.

A mechanically resistant outer layer is essential.

There are four operating cases with the outside pressure:

(i) outer layer sealed; polymer cavities not liable to flooding, (ii) outer layer sealed; polymer cavities liable to flooding, (iii) outer layer non-sealed; polymer cavities not liable to flooding, (iv) outer layer non-sealed; polymer cavities liable to flooding.

Cases (i) and (ii) are dismissed because the dimensioning of the outer layer leads to too rigid a device.

In case (iii), the pressure of some ten megapascals on a porous material whose matrix has a modulus of the order of 1 megapascal greatly reduces the volumes of the cavities, which tends to bring the apparent stiffness of the material back to a value of the order of 1 megapascal, a value that is much too high according to the present invention.

The cavities therefore have to be liable to flooding, and flooded, and the water must circulate freely.

The structure according to FIG. 3A meets all these functions. The protective tubes are parallel to the pipe, stuck to one another and protected by outer metal shells.

Calculation of the Radial Stiffness of a Rigid Pipe Embedded in a Cylinder of Small-diameter Protective Polymer Tubes Among the variety of hypotheses, the stiffest condition is always favoured. One can thus reasonably think that the stiffness ultimately found will be an approximation by rounding up of the theoretical value, which gives us an implicit safety margin for the present application. Every time such a hypothesis is made, it will be mentioned by the note "(HR)".

In FIG. 3A, a is the radius of the pipe and b the radius of the outer sheath, assumed to be rigid (HR). Furthermore, the protective tubes or the pipe are assumed not to become detached (HR).

The developments below are independent of the length of the system. All the quantities will be mentioned in relation to an arbitrary length B.

R denotes the radius of the protective tubes forming the sheath, e their thickness, E their Young's modulus and v their Poisson's ratio.

We assume that a lineic force F is applied onto the rigid pipe, and its displacement in relation to the rigid skin of the sheath is denoted by u. The value of the stiffness K=F/u (in N/m/m) is sought.

In section 1, we use arc calculations (Timoshenko S. P., Résistance des matériaux, tome 2, pp.71–73, Dunod) to obtain an isotropic linear elastic behaviour law for an assembly of protective tubes in small transformations (probably HR because beyond, buckling is likely to appear and to soften the structure).

Then, in section 2, we use an analytical solution (Sokolnikoff I. S., 1956, Mathematical Theory of Elasticity, p.289 sqq., Section 78) to estimate the stiffness sought for the homogenized material constructed in section 1. Plane-deformation calculations are carried out (HR).

Section 3 allows to observe the logarithmic dependence of the stiffness with the geometrical parameter b/a, and examines for which reasonable values of the parameters the proposed (material+geometry) solution is acceptable.

Section 1: Stiffness matrix for collapse of a protective tube

We consider a square network of protective tubes whose thickness, Young's modulus and Poisson's ratio are given above. It is designed to be modelled by means of an isotropic homogeneous material of Poisson's ratio $\nu_m$ and of Young's modulus $E_m$. We obtain an upper stiffness boundary by examining a Representative Elementary Volume (REV) consisting of a ring loaded with homogeneous displacement conditions (HR).

Furthermore, the deformations are modelled as plane deformations (HR). This is justified by the use that will be made of the present model in section 2.

We exert at points A and C (see FIG. 5) respectively forces $F_x$ and $F_y$, carried by the axes and in their direction (and the forces opposite the two opposite points). The displacements of the protective tube at the intersection of axes $\delta_x$ and $\delta_y$ are assumed to result therefrom. We find in Timoshenko that, in the case where $F_x=0$, the values of the displacements are:

$$\begin{cases} \delta_x = -\dfrac{F_y R^3}{E' I}\left[\dfrac{1}{\pi} - \dfrac{1}{4}\right], \\ \delta_y = \dfrac{F_y R^3}{E' I}\left[\dfrac{\pi}{8} - \dfrac{1}{\pi}\right], \end{cases}$$

where the Young's modulus is replaced by its plane-deformation equivalent:

$$E' = \frac{E}{1 - \nu^2}.$$

The symmetry of the structure allows to establish that, in the presence of a non-zero horizontal force, the displacements are then:

$$\begin{cases} \delta_x = \dfrac{F_x R^3}{E' I}\left[\dfrac{\pi}{8} - \dfrac{1}{\pi}\right] - \dfrac{F_y R^3}{E' I}\left[\dfrac{1}{\pi} - \dfrac{1}{4}\right], \\ \delta_y = -\dfrac{F_x R^3}{E' I}\left[\dfrac{1}{\pi} - \dfrac{1}{4}\right] + \dfrac{F_y R^3}{E' I}\left[\dfrac{\pi}{8} - \dfrac{1}{\pi}\right]. \end{cases}$$

By regarding the deformations and stresses of the homogenized block, respectively, as the local stresses and displacements as follows:

$$\begin{cases} \delta_x = R\varepsilon_{xx}, \\ \delta_y = R\varepsilon_{yy}, \\ F_x = 2RB\sigma_{xx}, \\ F_y = 2RB\sigma_{yy}, \end{cases}$$

we have:

$$\begin{cases} \varepsilon_{xx} = \dfrac{2BR^3}{E'I}\left[\dfrac{\pi}{8} - \dfrac{1}{\pi}\right]\sigma_{xx} - \dfrac{2BR^3}{E'I}\left[\dfrac{1}{\pi} - \dfrac{1}{4}\right]\sigma_{yy}, \\ \varepsilon_{yy} = -\dfrac{2BR^3}{E'I}\left[\dfrac{1}{\pi} - \dfrac{1}{4}\right]\sigma_{xx} + \dfrac{2BR^3}{E'I}\left[\dfrac{\pi}{8} - \dfrac{1}{\pi}\right]\sigma_{yy}. \end{cases}$$

If we agree that the behaviour is substantially isotropic in plane (x,y), it is possible to identify a homogenized Poisson's ratio and Young's modulus $\nu_h$, $E_h$. We therefore remind that we are within the context of plane deformations. Consequently, the out-of-plane deformation being zero, we have:

$$\sigma_{xx}=\nu_h(\sigma_{xx}+\sigma_{yy}),$$

and the plane behaviour law is written as follows:

$$\begin{cases} \varepsilon_{xx} = \dfrac{1-\nu_h^2}{E_h}\sigma_{xx} - \dfrac{\nu_h(1+\nu_h)}{E_h}\sigma_{yy}, \\ \varepsilon_{yy} = -\dfrac{\nu_h(1+\nu_h)}{E_h}\sigma_{xx} + \dfrac{1-\nu_h^2}{E_h}\sigma_{yy}. \end{cases}$$

The identification gives:

$$\frac{\nu_h}{1-\nu_h} = -\frac{-\dfrac{2BR^3}{E'I}\left[\dfrac{1}{\pi} - \dfrac{1}{4}\right]}{\dfrac{2BR^3}{E'I}\left[\dfrac{\pi}{8} - \dfrac{1}{\pi}\right]} = \frac{8-2\pi}{\pi^2-8},$$

hence:

$$\nu_h = \frac{8-2\pi}{\pi(\pi-2)} \approx 0{,}47870.$$

We then have:

$$\frac{E_h}{1-\nu_h^2} = \frac{E'I}{2BR^3}\left[\frac{8\pi}{\pi^2-8}\right],$$

which becomes, by making $\nu_h$ explicit and by using $I=Be^3/12$:

$$E_h = \frac{\pi^2-4\pi+8}{3\pi(\pi-2)^2}\frac{E}{1-\nu^2}\left(\frac{e}{R}\right)^3 \approx 0{,}43177\cdot\frac{E}{1-\nu^2}\left(\frac{e}{R}\right)^3.$$

Consequently, we consider hereafter that the assembly of protective tubes behaves in plane deformations as an isotropic body of homogenized Poisson's ratio and Young's modulus $\nu_h$, $E_h$ identified above.

Section 2: Behaviour of the Block

The present section uses these parameters to calculate the sinking under a lineic force $R_n$ along an axis arbitrarily denoted by x. The problem relates to the displacement (in plane deformations) of a rigid pipe (representing the SCR in the device) in a concentric rigid sheath (HR). To deal with it, we use the analytical solution of the problem posed by the displacement under force $R_n$ of a rigid disc of radius a in an isotropic infinite block of Poisson's ratio and Young's modulus $\nu_h$, $E_h$, in plane deformation. Reference "Sokolnikoff I. S., 1956, Mathematical Theory of Elasticity, p.289 sqq., Section 78" gives all the important elements. The mechanical fields depend on the two conventional potentials, functions of the complex variable z=x+i y, from Muskhelishvili's formalism. (see for example: Leblond J. -B., 2003, Mécanique de la rupture fragile et ductile, Hermes):

$$\begin{cases} \varphi(z) = H\log\dfrac{a}{z}, \\ \psi(z) = -H\kappa\log\dfrac{a}{z} + H\dfrac{a^2}{z^2}, \end{cases}$$

with:

$$\kappa = 3-4\nu_h \ \ et \ \ H = \frac{R_n}{2\pi(1+\kappa)}.$$

We can deduce therefrom the expression for the displacements and the stresses using (see Leblond J. -B., 2003, Mécanique de la rupture fragile et ductile, Hermes, pp.45 to 48):

$$\begin{cases} u_x + iu_y = \dfrac{1+\nu_h}{E_h}\left(\kappa\varphi(z) - z\overline{\varphi'(z)} - \overline{\psi(z)}\right), \\ \sigma_{xx} + \sigma_{yy} = 2\left[\varphi'(z) + \overline{\varphi'(z)}\right], \\ \sigma_{xx} - \sigma_{yy} + 2i\sigma_{xy} = 2[\bar{z}\varphi''(z) + \psi'(z)]. \end{cases}$$

Thus, we first find that, on the sheath, at $z=be^{i\theta}$, $$u_x = \frac{1+\nu_h}{E_h}\frac{R_n}{2\pi(1+\kappa)}\left[2\kappa\log\frac{a}{b} + \left(1+\frac{a^2}{b^2}\right)(\cos^2\theta - \sin^2\theta)\right],$$

hence, by regarding the displacement of the central pipe in the direction of the force applied δ as the opposite of the mean of the displacement of the virtual ring consisting of the affix points $z=be^{i\theta}$ (we have checked that selection of the constants in the solution chosen leads to a zero mean displacement of the central pipe):

$$\delta = \frac{1+\nu_h}{E_h}\frac{R_n}{2\pi(1+\kappa)}2\kappa\log\frac{b}{a}.$$

We deduce therefrom the value of the desired stiffness:

$$K \equiv \frac{R_n}{\delta} = E_h\frac{4\pi}{\log\dfrac{b}{a}}\frac{(1-\nu_h)}{(3-4\nu_h)(1+\nu_h)},$$

i.e., with five decimals, according to section 1:

$$K \equiv \frac{R_n}{\delta} = 1{,}76263\cdot\frac{E}{1-\nu^2}\left(\frac{e}{R}\right)^3\frac{1}{\log\dfrac{b}{a}}.$$

We can find a polymer having a Young's modulus of the order of 50 MPa with a Poisson's ratio of the order of 0.4. If we take b/a ratios of the order of 3, and e/R ratios of the order of 0.1, we reach the following order of magnitude:

$$K \equiv \frac{R_n}{\delta} \sim 95 \text{ kPa},$$

which corresponds to the desired order of magnitude.

It can be noted, on the formula obtained, that:

(i) the b/a ratio, if it is selected large, is of little consequence, through a logarithm, (ii) on the other hand, if it is small, the logarithm has to be approximated by b/a−1, (iii) ratio e/R, which appears to the power 3, has a great influence.

It is thus clear that we can be optimistic as regards the possibility of reaching the desired low stiffness by adjusting the physical (characteristics of the material to be selected) and geometrical parameters (radius of the central pipe, outside radius of the sheath, microstructure (in the example selected: thickness and radius of the protective tubes)).

By way of sensitivity analysis, we examine the new values that should be selected separately for the two geometrical parameters b/a and e/R so as to have, on the one hand, a multiplication by 2 of the stiffness and, on the other hand, its division by 2. The result is given in the table below and allows to fix useful intervals for the values of these two geometrical parameters:

| Stiffness K | b/a | e/R |
|---|---|---|
| 95 kN/m/m | 3 | 0.1 |
| 190 kN/m/m | 1.73 | 0.1 |
| 190 kN/m/m | 3 | 0.126 |
| 47.5 kN/m/m | 9 | 0.1 |
| 47.5 kN/m/m | 3 | 0.079 |

It has to be checked that the displacements reached do not lead to exceed the allowable limit of the material defined according to a predetermined life. We examine the value of the components of the stress tensor. Examination of the potentials immediately shows that they are maximum on the edge of the pipe $z=ae^{i\theta}$, and the Muskhelishvili formalism reminded above gives:

$$\begin{cases} \sigma_{xx} = \frac{H}{a}[-(1+\kappa)\cos\theta + \cos 3\theta], \\ \sigma_{yy} = \frac{H}{a}[-(1-\kappa)\cos\theta - \cos 3\theta], \\ \sigma_{xy} = \frac{H}{a}[-\kappa\sin\theta + \sin 3\theta]. \end{cases}$$

A quick examination shows that the values in square brackets have a maximum slightly above 2, of the order of 2.15. The stress maximum thus has the following boundary:

$$\sigma_{\max} < \frac{2.15K}{\pi(1+\kappa)}\frac{\delta}{a}.$$

To analyse the harmfulness of these stresses, they have to be translated on the microscopic scale of the structure.

A quick analysis shows that the protective tubes close to the pipe are subjected to a force $F \sim 2R\sigma_{max}$ such that their sinking, calculated by assuming the material to be elastic, would be of the order of:

$$\delta_x = R\varepsilon_{xx} \sim \frac{R\delta}{a}\frac{2,15}{\pi(1+\kappa)}\frac{4\pi}{\log\frac{b}{a}}\frac{(1-\nu_h)}{(3-4\nu_h)(1+\nu_h)},$$

$$\text{hence: } \frac{\delta_x}{R} \sim 1.7\frac{\delta}{a}.$$

Thus, if we reach δ ~30 mm for a pipe whose radius is of the order of 250 mm, this leads to a flattening of the protective tubes of the order of 20%, which is reasonable for a soft polymer structure.

The value of δ thus greatly depends on the stresses imposed at the riser head, therefore on the environmental conditions. In practice, the stresses are less severe than those selected here. In relation to the sinking due to its own weight, the dynamic effects and the taking up of the bending stresses lead to an over-sinking of the pipe of the order of 70%, i.e. δ~17 mm, which leads to a flattening of the protective tubes of the order of 12%, which is very reasonable for a soft polymer structure.

However, for the adjustment of the device, this study has to be completed by an analysis of the following points:

- the protective tube piling model (calculation of $E_h$ and $\nu_h$) has to be made isotropic,
- in this model, the extension of the contact zone between adjacent protective tubes during the macroscopic compression has to be taken into account,
- in order to optimize the deformation distribution, the effect of the use of different protective tubes, a priori stiffer at the center and softer on the periphery, can be studied,
- because the fatigue life is likely to be shorter than the life desired for the SCR, a half-shell geometry can be proposed, which allows in-situ replacement, at predetermined periodicities, during the life of the SCR,
- the non-linear effects have been deliberately disregarded at this stage. In particular, a punctual contact between the protective tubes making up the sheath has been assumed.

EMBODIMENT EXAMPLES

The first device according to FIG. 6 consists of:

- a material 20 allowing the desired stiffness to be guaranteed (maximum value of the order of 100 kPa),
- two cheeks 21 sufficiently flexible to adjust the internal and external pressure difference to the device,
- an abrasion and ground friction protection shell 22,
- two flexible cheek protection shells 23 (optional),
- a non-return valve 24 or any other type of device allowing filling of the device during the riser descent and thus bringing it to equipressure.

The material providing stiffness is open and liable to flooding. It has to guarantee, through selection of a suitable material and structure, the maximum stiffness of the system. It is possible to consider a stuck assembly of tubes (FIG. 3A), an open-pore foam, or a moulded elastomer block machined to form longitudinal channels, in order to obtain a product equivalent to the tube assembly.

Sealing against ooze is ensured so as not to clog the open material (tubes, foam or channels), which would eventually lead to increase its stiffness.

In the case of a solution as shown in FIG. 3A, the glued tube assembly can have the form of a preformed block or of a layer of parallel tubes that can be wound round the pipe.

The stiffness of the material in a radial direction can be variable so as to best distribute the stresses over the thickness of the sheath.

The material guaranteeing the maximum stiffness can consist of one or more identical sections arranged longitudinally on the pipe and spaced out so as to provide intermediate clearance zones.

Installation Principle (FIGS. 7*a, b, c, d*)

In the case of J-shaped pipe laying, and when the pipe elements cannot be equipped with the device at the factory, installation is carried out on the lay barge, below the welding set. The flexible cheeks are arranged before descent of the riser on a tube of larger diameter than the diameter of the pipe elements.

The first cheek is slipped onto the pipe (FIG. 7*a*). The pipe is lowered by the length of the device. The material providing stiffness is arranged around the riser (in one, two or more parts, or wound as a layer) and the closing cheek is slipped onto the element (FIG. 7*b*). The outer protective shell is fastened to the device (FIG. 7*c*). The sealing cheeks are arranged around the pipe (FIG. 7*d*).

The whole of the pipe can continue its descent until the next device is installed.

Figure 8:
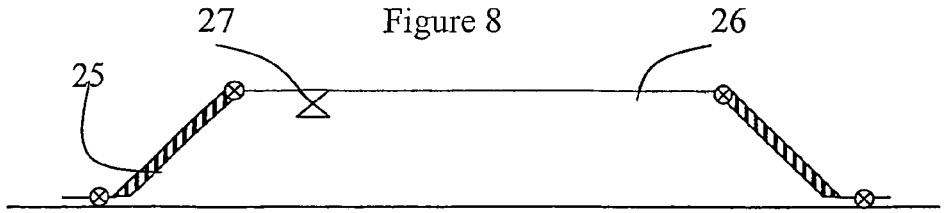
FIGS. 8, 9, 10*a* and 10*b* show embodiment variants, FIG. 10*b* being a cross-section of the embodiment according to FIG. 10*a*.

The variant of the device according to FIG. 8 consists of:

two cheeks 25 allowing to guarantee the desired maximum stiffness according to the invention (maximum value, for example, of the order of 100 kPa), a protective shell 26 also guaranteeing sealing against the surrounding ooze, a non-return valve 27 (or any other equivalent device) allowing filling of the inside of the device as it is lowered and therefore bringing it to equipressure.

Figure 9:
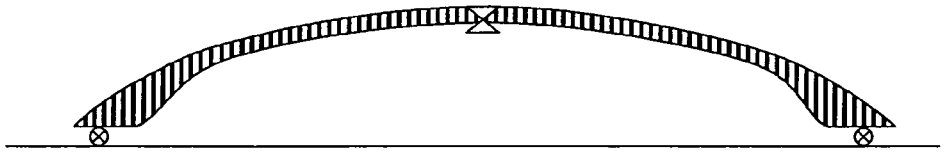

FIG. 9 shows another variant:

the cheek is a reinforced elastomer membrane, and the protective shell (in continuity with the cheeks) contributes to the stiffness of the device (FIG.9).

Figure 10A:
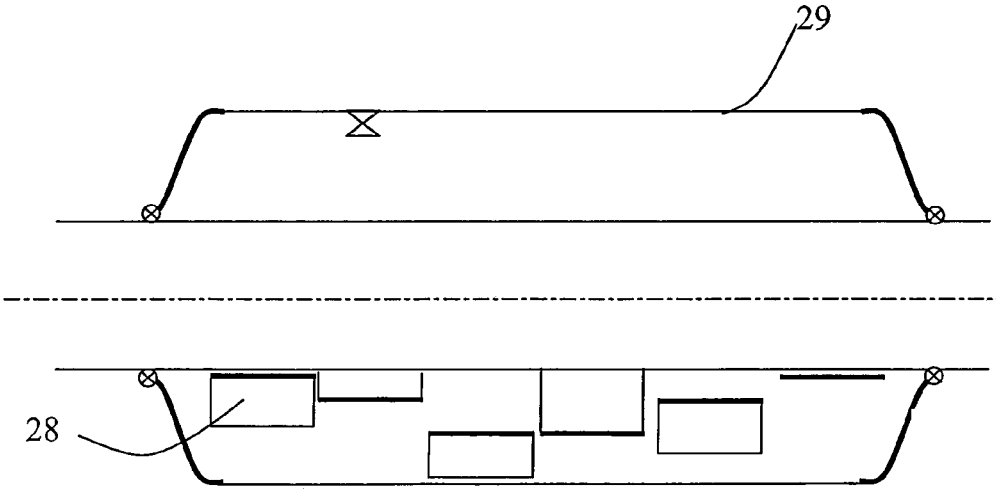
Figure 10B:
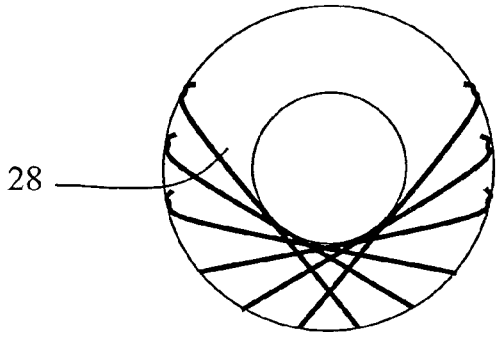

The device according to FIGS. 10*a* and 10*b* consists of:

flexure blades 28 allowing to obtain the desired maximum stiffness (about 100 kPa), arranged so as to allow rotation of the pipe in the device, an outer rigid shell 29 sealed against ooze and providing protection against abrasion and ground friction.

The invention claimed is:

1. A device for improving the fatigue strength of a metal pipe one portion of which lies on the sea bottom and one end of which is suspended from a floating support subjected to the dynamic motions of the sea which move the touchdown point (TDP) of the pipe, said device comprising stress limiting means including a material inserted between said pipe and the ground, in the vicinity of said touchdown point, said material having a lineic stiffness below 200 kN/m/m, and physical and geometrical parameters determined in such a way that the deformations of the material do not exceed an allowable limit defined according to a determined life.

2. A device as claimed in claim 1, wherein said means are cylindrical and surround the pipe over a determined length.

3. A device as claimed in claim 2, wherein said material consists of an assembly of protective tubes open at the ends thereof.

4. A device as claimed in claim 3, wherein said protective tubes are made of soft polymer.

5. A device as claimed in claim 3 wherein, said protective tubes having a radius R, a wall thickness e, for a radius b of a cylinder arranged around a pipe of radius a, b/a ranges between 1.73 and 9, and e/R ranges between 0.079 and 0.126.

6. A device as claimed in claim 1, wherein the length of said stress limiting means ranges between 1 and 100 m, preferably between 2 and 10 m.

7. A device as claimed in claim 3, wherein the assembly of protective tubes is open to flooding.

8. A device as claimed in claim 7, further comprising a protective shell provided around an outer circumference of the assembly of protective tubes, and a means for allowing flooding of the assembly of tubes.

9. A device as claimed in claim 8, wherein the means for allowing flooding comprises a non-return valve.

10. A device as claimed in claim 8, further comprising a pair of cheeks provided at respective ends of the assembly of tubes, the cheeks providing a maximum desired stiffness for the device.

11. A device as claimed in claim 3, wherein a plurality of said assemblies of protective tubes are provided in spaced sections along the metal pipe.

12. A device as claimed in claim 11, wherein said plurality of assemblies is provided only in the vicinity of said touchdown point.

13. A device as claimed in claim 1, wherein said stress limiting means are provided only in the vicinity of said touchdown point.

14. a device as claimed in claim 1, wherein said metal pipe is a steel catenary riser pipe.

* * * * *